United States Patent [19]

Kondo et al.

[11] Patent Number: 4,752,992

[45] Date of Patent: Jun. 28, 1988

[54] SLIDE FASTENER WITH THERMOPLASTIC END STOPS

[75] Inventors: Naoki Kondo; Yoshinori Fujisaki, both of Kurobe, Japan

[73] Assignee: Yoshida Kogyo K. K., Tokyo, Japan

[21] Appl. No.: 24,679

[22] Filed: Mar. 11, 1987

[30] Foreign Application Priority Data

Mar. 12, 1986 [JP] Japan ..... 61-35543

[51] Int. Cl.[4] ..... A44B 19/36

[52] U.S. Cl. ..... 24/436; 24/397

[58] Field of Search ..... 24/436, 435, 428, 397, 24/398, 381, 384, 389

[56] References Cited

U.S. PATENT DOCUMENTS

| | | | |
|---|---|---|---|
| 2,341,331 | 2/1944 | Parkin | 24/436 |
| 2,474,908 | 7/1949 | Morin | 24/435 |
| 2,558,239 | 6/1951 | Disinger | 24/436 |
| 2,893,093 | 7/1959 | Erdmann | 24/436 |
| 2,988,796 | 6/1961 | Johns | 24/436 |
| 3,436,041 | 4/1969 | Haller | 24/397 |
| 3,672,008 | 6/1972 | Moertel et al. | 24/436 |
| 3,813,459 | 5/1974 | Potin . | |
| 3,862,474 | 1/1975 | Ebata . | |
| 4,078,278 | 3/1978 | MacFee . | |
| 4,155,147 | 5/1979 | Akashi | 24/436 |

FOREIGN PATENT DOCUMENTS

| | | |
|---|---|---|
| 2309624 | 9/1974 | Fed. Rep. of Germany . |
| 2082871 | 11/1971 | France . |
| 4837421 | 11/1973 | Japan . |
| 4936975 | 10/1974 | Japan . |
| 5122867 | 7/1976 | Japan . |
| 5217945 | 2/1977 | Japan . |
| 5515201 | 4/1980 | Japan . |
| 898772 | 6/1962 | United Kingdom . |
| 1297487 | 11/1972 | United Kingdom . |
| 1479440 | 7/1977 | United Kingdom . |
| 2081805 | 2/1982 | United Kingdom . |

*Primary Examiner*—Victor N. Sakran

*Attorney, Agent, or Firm*—Hill, Van Santen, Steadman & Simpson

[57] ABSTRACT

A slide fastener 10 includes an end stop which is made of a thermoplastic material and allowed on melting by ultrasonic or high-frequency fusion to permeate yarns of fastener tapes, penetrate the interstices or openings in the tapes and fuse together at the confronting ends of the end stop with the tape sandwiched therebetween thereby firmly anchoring the same in place against movement even under increased stresses.

11 Claims, 4 Drawing Sheets

SLIDE FASTENER WITH THERMOPLASTIC END STOPS

BACKGROUND OF THE INVENTION

1. Field of the Invention

This invention relates generally to slide fasteners and more particularly to end stop devices therefor. The slide fastener is provided with a slider receiprocally movable for opening and closing the same, the reciprocal movement of the slider being limited by stop members mounted on the top and bottom ends of the fastener.

2. Prior Art

There has been proposed a variety of fastener end stops, some being made of metal and others of plastic. Those made of thermoplastic materials to which the invention appertains are typically disclosed for example in Japanese patent Publication Nos. 48-37421 and 49-36975, in which a piece of thermoplastic film or monofilament is attached by welding thermally or ultrasonically to an inner edge of a slide fastener tape, so that the film, fastener elements and tape yarns are integrally joined together. Such conventional end stops are however not entirely satisfactory in that their bondage to the fastener is reduced particularly where the fastener tapes are formed by different, relatively long filament yarns which present a slippery tape surface. Other difficulties of the prior art devices are found in that when end stops are attached to woven or knitted tapes having surface irregularities, the thermoplastic resin of the end stops tends to produce objectionable burrs or fins which would not only mar the product value but also present a fear for physical injury to the user, and in that when end stops are applied only to one side of the tape, their anchorage thereto is insufficient to withstand impinging forces exerted by the slider.

SUMMARY OF THE INVENTION

It is the primary object of the present invention to provide improved end stops for slide fasteners which will eliminate or alleviate the foregoing difficulties of the prior art devices. More specifically, the invention is aimed at the provision of fastener end stops made of a thermoplastic material which are applied to both sides of fastener tapes by means of ultrasonic, high-frequency or heat processing in such a manner that opposite end portions of each end stop are fused together through interstices or openings in a fabric tape of either woven or knitted structure.

The above and other objects and features of the invention will be better understood from the following description taken in conjunction with the accompanying drawings which illustrate by way of example same preferred embodiments of the invention and in which like reference numerals refer to like and corresponding pasrts throught the several views.

DETAILED DESCRIPTION OF THE INVENTION

Figure 1:
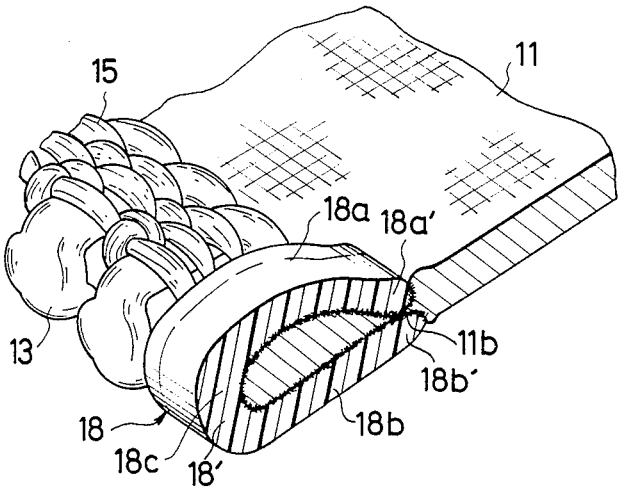
FIG. 1 is a fragmentary perspective view on enlarged scale of a slide fastener stringer to which a top end stop embodying the invention is applied at its top end.
Figure 2:
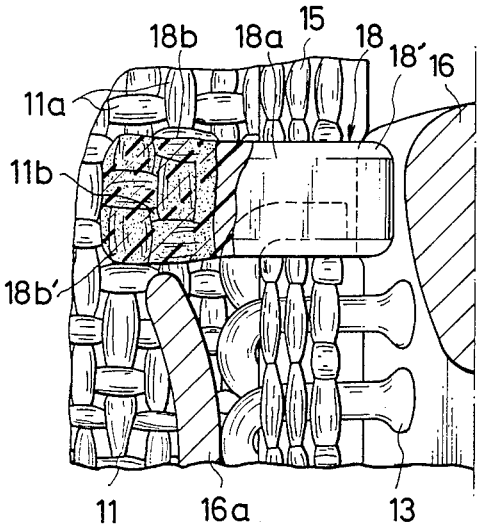
FIG. 2 is a plan view partly cut away of the slide fastener stringer of FIG. 1.
Figure 3:
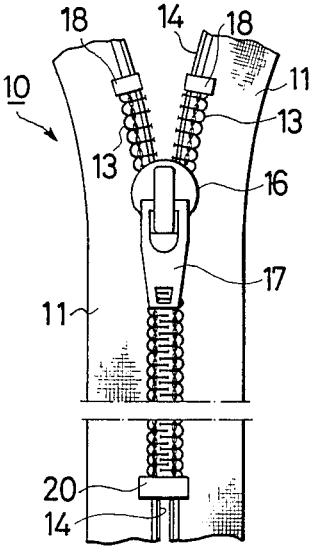
FIG. 3 is a plan view of a slide fastener having end stops of the invention applied at both its top and bottom ends.

Referring now to the drawings and firstly to FIG. 3, there is shown a slide fastener 10 which comprises a pair of identical stringer tapes 11, 11 each carrying a continuous row of coupling elements 13 along its inner longitudinal edge 14, the coupling elements 13 being secured to the tape edges as by sewing threads 15 as better shown in FIGS. 1 and 2. A slider 16 has a pull tab 17 with which the slider is normally moved along the rows of coupling elements 13 in one direction to open and the other direction to close the slide fastener 10 in a manner well known in the art. The reciprocal movement of the slider 16 in a direction to close the fastener 10 is limited or stopped at the top end of the fastener 10 by a pair of top end stops 18, 18 as the slider flanges **16*a* (shown in FIG. 2) are brought into abutting engagement with the respective end stops 18. Movement of the slider 16 in a direction to open the fastener 10 is limited or stopped at the bottom end of the fastener 10 as it comes into contact with a bottom end stop 20**.

Figure 4:
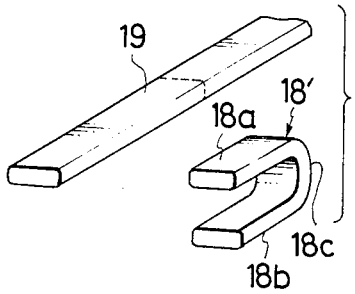
FIG. 4 is a perspective view of a starting form of a top end stop according to the invention.

FIG. 4 shows a starting form of the top end stop 18 made of a thermoplastic resin such as polyester, polyamide or the like which initially assumes an elongated monofilamentary strip 19 of predetermined width and thickness. This elongated strip is cut to a predetermined length as along the dotted-line and centrally folded on itself to provide a substantially U-shaped staple-like end stop blank 18' having an upper leg **18*a* and a lower leg 18*b* interconnected by a rounded corner 18*c***.

Figure 5:
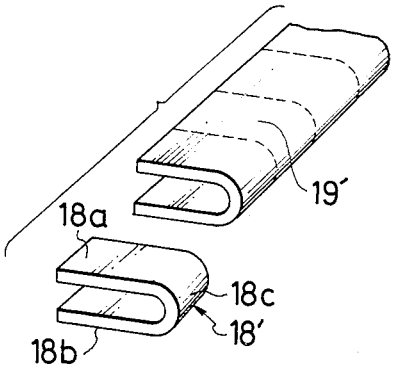
FIG. 5 is a perspective view of another form of a top end stop according to the invention.

Another starting form of top end stop 18 is shown in FIG. 5 as designated at 19', which is a profile cut to provide a U-shaped end stop blank 18' identical to that of FIG. 4.

The U-shaped blank 18', as shown in FIGS. 1 and 2, is mounted astride the edge 14 of a woven tape 11 in close proximity to a terminal one of the coupling elements 13, and anchored in place by ultrasonic or high-frequency fusion of the material of the blank 18' while the latter is molded into a final shape free of burrs or fins, in which instance the upper leg 18*a* is deformed with its end portion 18*a'* pressed against confronting end portion 18*b'* of the lower leg 18*b* which lies straight against and in parallel with the plane of the tape 11. The blank 18' envelopes therein the sewing threads 15 together with the tape edge 14 when it is mounted on the latter. This deforming action causes individual yarns 11*a* of the tape 11 to spread apart to provide openings 11*b* of widened interstices or pores through which the molten resin material of the blank 18' penetrates and adhesively join the confronting ends 18*a'*, 18*b'* of the respective legs 18*a*, 18*b* to provide the top end stop 18. Ultrasonic processing as applied in FIGS. 1 and 2 creates a hammering action which is transmitted through the blank 18' to the woven tape 11, to cause woven yarns 11*a* to spread apart thereby to provide desired openings 11*b*.

Figure 6:
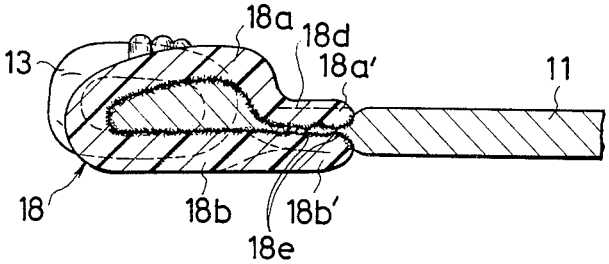
FIG. 6 is a transverse cross-sectional view of a slide fastener carrying a modified form of top end stops according to the invention.

FIG. 6 shows a modified embodiment of the invention in which the upper leg 18*a* is deformed to provide a swollen portion 18*d* contiguous to the fused ends 18*a'*, 18*b'* which thus serves effectively as an abutment for engagement with the slider flange 16*a* (FIG. 2). A plurality of projections 18*e* may be formed integrally on the confronting surfaces of the ends 18*a'*, 18*b'* of the upper and lower legs 18*a*, 18*b* so as to facilitate the intrusion of the resin material of the blank 18' into the openings 11*b*.

Figure 7:
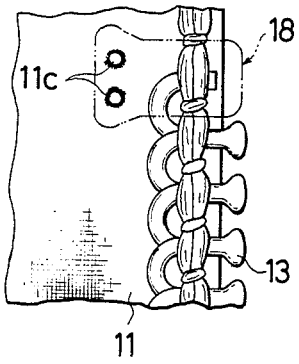
FIG. 7 is a fragmentary plan view of a modified slide fastener tape to which the top end stop of the invention is applied.

FIG. 7 shows a fastener stringer tape 11 having bores 11*c* which are preformed as by punching and which should be peripherally fused to avoid frays, the bores 11*c* being utilized for the passage of molten resin of the blank 18'.

Figure 8:
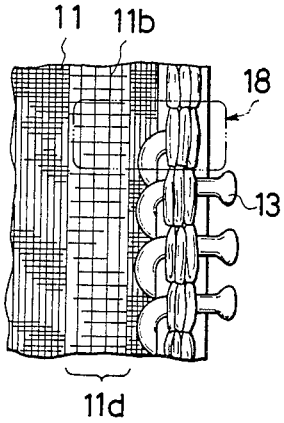
FIG. 8 is a view similar to FIG. 7 but showing another form of tape to which the inventive top end stop is applied.

The openings 11*b* for the same purpose may be formed by providing the weave of the tape 11 with a coarse interstice portion 11*d* as shown in FIG. 8 or by inserting heated pin tools into the interstices to spread permanently the same.

Figure 9:
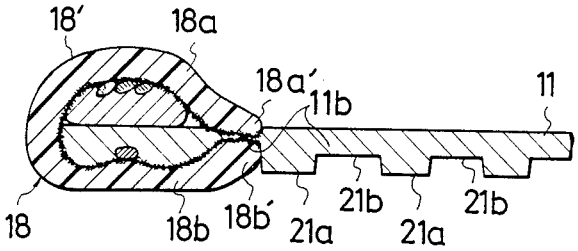
FIG. 9 is a transverse cross-sectional view of a knit fastener tape to which the inventive top end stop is applied.

FIG. 9 shows a top end stop 18 mounted on a knitted tape 11 having alternate wales 21*a* and grooves 21*b* in which instance the ends 18*a'* and 18*b'* of the end stop blank 18' are confronted across the groove 21*b* which has coarse interstices serving as openings 11*b* for the penetration of the molten resin of the staple 18'.

Figure 10:
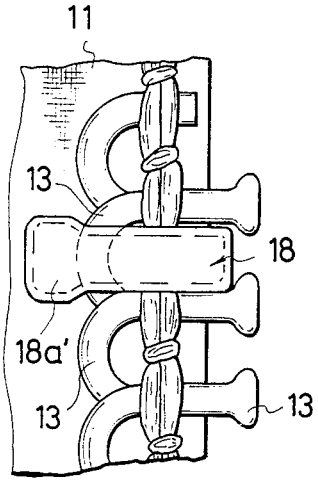
FIGS. 10 and 11 are fragmentary plan views showing the top end stops applied at different positions on the fastener stringers.
Figure 11:
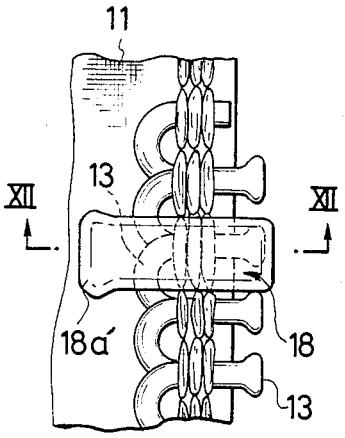
Figure 12:
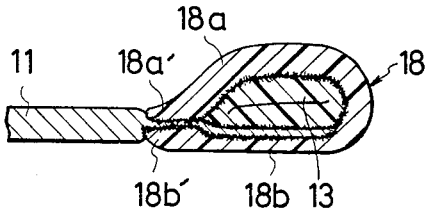
FIG. 12 is a transverse cross-sectional view taken on the line XII—XII of FIG. 11.

FIG. 10 shows the top end stop 18 mounted in between adjacent coupling elements 13, while the end stop 18 may alternatively be mounted directly over the coupling elements 13 and fused in place together therewith as shown in FIGS. 11 and 12.

Figure 13:
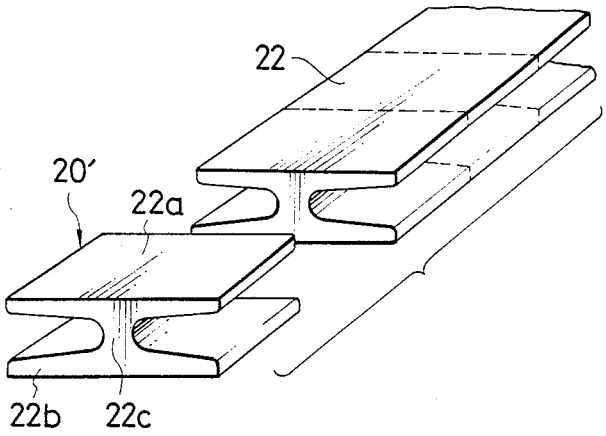
FIG. 13 is a perspective view on enlarged scale of a starting form of a bottom end stop embodying the invention.

There is shown in FIG. 13 a bottom end stop blank 20' of a generally H-shape made of a thermoplastic material similar to the blank 18' which is cut along the dotted line into starting blocks 22 for bottom end stops 20 each having an upper wing 22*a* and a lower wing 22*b* interconnected centrally by a connecting neck 22*c*. This end stop blank 20' is mounted at the bottom end of each of the tapes 11 and 12 with the tape edges 14 inserted between and gripped by the upper and lower wings 22*a* and 22*b* and anchored in place, as shown in FIG. 14, by fusing respective ends 22*a'*, 22*b'*; 22*a'*, 22*b'* of the blank 20' of the thermoplastic material in a similar processing to that applied for the formation of the top end stops 18.

Figure 14:
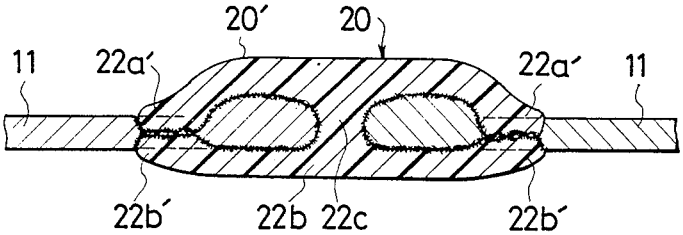
FIGS. 14 and 15 are transverse cross-sectional views of fastener stringers to which the inventive bottom stops are applied in different fashions.
Figure 15:
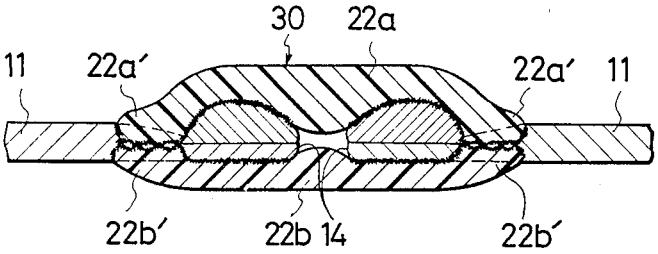

FIG. 15 shows a modified form of bottom end stop 30 which is similar to the bottom end stop 20 of FIG. 14 except that the modified end stop 30 is devoid of the neck 22*c*; that is, the starting form being two separate wings 22*a* and 22*b* that are juxtaposed over the confronting tape edges 14 and applied to the tape in a manner similar to the bottom end stop 20.

According to the invention, the top end stops 18, 19 and the bottom end stops 20 alike can be securely anchored in place on the fastener tapes 11, 12 against displacement on impinging contact with the slider 16, this being accomplished by the adhesive system in which the thermoplastic resinous material constituting the end stops is allowed on melting to permeate the yarns of the tapes, penetrate through their interstices or openings 11*b* and fuse together at the confronting ends of the end stops.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slide fastener comprising:

(a) a pair of slide fastener stringers each having a stringer tape and a row of coupling elements mounted on and along an inner longitudinal edge of each stringer tape, said stringer tape having a porous structure;

(b) a slider slidably mounted on the two rows of coupling elements to take them into and out of interdigitating engagement with each other to close and open the slide fastener;

(c) an end stop of thermoplastic synthetic resin attached to at least one of said fastener stringer tapes adjacent to an end of said row of coupling elements to prevent said slider from leaving the coupling elements, said end stop including upper and lower wings disposed one on opposite faces of said one stringer tape; and (d) said stringer tape including a compressively deformed thin portion having an enlarged pore size due to compressive deformation thereof, said wings having confronting one end portions disposed on said thin portion and fused together through enlarged pores in said thin portion.

2. A slide fastener according to claim 1, wherein said end stop is a top end stop, said upper and lower wings being integrally joined together at the other ends thereof thereby forming a rounded corner.

3. A slide fastener according to claim 1, wherein said one end portions of said wings are fused together through bores formed as by punching said tape.

4. A slide fastener according to claim 1, wherein said stringer tapes include coarse interstice portions extending along the respective inner longitudinal edges, and said end portions of said wings are disposed on said coarse interstice portions.

5. A slide fastener according to claim 1, wherein said upper wing is deformed to provide a swollen portion, while said lower wing lies straight against said tape.

6. A slide fastener according to claim 1, wherein said end stop is anchored in place between adjacent ones of said coupling elements.

7. A slide fastener according to claim 1, wherein said end stop is anchored in place over at least one of said coupling elements.

8. A slide fastener comprising:

(a) a pair of slide fastener stringers each having a stringer tape and a row of coupling elements mounted on and along an inner longitudinal edge of each stringer tape, said stringer tape being a woven tape having a porous structure;

(b) a slider slidably mounted on the two rows of coupling elements to take them into and out of interdigitating engagement with each other to close and open the slide fastener; and (c) an end stop of thermoplastic synthetic resin attached to at least one of said fastener stringer tapes adjacent to an end of said row of coupling elements to prevent said slider from leaving the coupling elements, said end stop including upper and lower wings disposed one on opposite faces of said one stringer tape, said wings having respective one end portions fused to each other and extending through pores in said stringer tape, said one end portions of said wings being fused together through openings formed by enlarging interstices of the tape.

9. A slide fastener comprising:

(a) a pair of slide fastener stringers each having a stringer tape and a row of coupling elements mounted on and along an inner longitudinal edge of each stringer tape, said stringer tape being a knit tape having a porous structure;

(b) a slider slidably mounted on the two rows of coupling elements to take them into and out of interdigitating engagement with each other to close and open the slide fastener; and (c) an end stop of thermoplastic synthetic resin attached to at least one of said fastener stringer tapes adjacent to an end of said row of coupling elements to prevent said slider from leaving the coupling elements, said end stop including upper and lower wings disposed one on opposite faces of said one stringer tape, said wings having respective one end portions fused to each other and extending through pores in said stringer tape, said one end portions of said wings are fused together through openings of said knit tape at grooves disposed between adjacent pairs of wales of the same.

10. A slide fastener comprising:

(a) a pair of slide fastener stringers each having a stringer tape and a row of coupling elements mounted on and along an inner longitudinal edge of each stringer tape, said stringer tape having a porous structure;

(b) a slider slidably mounted on the two rows of coupling elements to take them into and out of interdigitating engagement with each other to close and open the slide fastener; and (c) an end stop of thermoplastic synthetic resin attached to at least one of said fastener stringer tapes adjacent to an end of said row of coupling elements to prevent said slider from leaving the coupling elements, said end stop being a bottom end stop including upper and lower wings disposed one on opposite faces of said one stringer tape, said upper and lower wings bridging the two stringer tapes at opposite faces of the latter, said upper and lower wings having respective opposite end portions fused correspondingly to each other through openings in said stringer tapes.

11. A slide fastener according to claim 10, wherein said upper and lower wings are joined integrally at their intermediate portions such that said end stop has a generally horizontal H-shaped cross section.

* * * * *